US005938453A

United States Patent [19]

Ichimura

[11] Patent Number: 5,938,453

[45] Date of Patent: Aug. 17, 1999

[54] TWO-PIECE ELECTRICAL CONNECTOR HAVING A REDUCED STATURE IN A MATING CONDITION BY PROVISION OF A FLEXIBLE CONTACT MEMBER BENDABLE IN ONE CONNECTOR MEMBER

[75] Inventor: Yoshiaki Ichimura, Akiruno, Japan

[73] Assignee: Japan Aviation Electronics Industry, Limited, Tokyo, Japan

[21] Appl. No.: 09/058,038

[22] Filed: Apr. 10, 1998

[51] Int. Cl.[6] ..... H01R 9/09

[52] U.S. Cl. ..... 439/67; 439/260

[58] Field of Search ..... 439/62, 67, 260, 439/632

[56] References Cited

U.S. PATENT DOCUMENTS

| | | | |
|---|---|---|---|
| 5,040,999 | 8/1991 | Collier | 439/62 |
| 5,316,486 | 5/1994 | Tanaka et al. | 439/62 |
| 5,622,505 | 4/1997 | Hashiguchi et al. | 439/67 |

FOREIGN PATENT DOCUMENTS 8-330031 12/1996 Japan .

*Primary Examiner*—Neil Abrams
*Assistant Examiner*—Jean F. Duverne
*Attorney, Agent, or Firm*—Laff, Whitesel & Saret, Ltd.

[57] ABSTRACT

In a two-piece electrical connector comprising a connector member and a mating connector member for electrically connecting a first and a second PCBs, the connector member comprising a first insulator block and a second insulator block coupled to each other. A flexible contact member is mounted in the first and the second insulator blocks and has a connecting portion to be connected to the first PCB and a contact portion to be brought into contact with mating contact portions of the mating connector member. The contact portion is provided with a backup spring having a free end. When subjected to pressing force by a press wall portion, the free end produces contacting force to press the contact portion to the mating contact portions by lever action. When the second insulator block is pushed down, the free end is deformed under the pressing force by the press wall portion and moved, as well as an intermediate portion of the flexible contact member is compressed and deformed. The first and the second insulator blocks are provided with first and second rotary shaft members to which the intermediate portion of the flexible contact member is wrapped to be deformed.

24 Claims, 5 Drawing Sheets

TWO-PIECE ELECTRICAL CONNECTOR HAVING A REDUCED STATURE IN A MATING CONDITION BY PROVISION OF A FLEXIBLE CONTACT MEMBER BENDABLE IN ONE CONNECTOR MEMBER

BACKGROUND OF THE INVENTION

This invention relates to a two-piece electrical connector for electrically connecting two printed circuit boards (PCBs) to each other and, in particular, to an electrical connector member having a flexible contact member such as an FPC (flexible printed circuit), an FFC (flexible flat cable) or the like to be inserted into a mating connector member under a ZIF (zero insertion force).

A known two-piece electrical connector of a ZIF type using FPCs as contact members is disclosed in Japanese Unexamined Patent Publication No. JP-A 8-330031 (330031/1996) corresponding to U.S. patent application with a Ser. No. 08/991,102 filed on Dec. 12, 1997. The known two-piece electrical connector is for electrically connecting first and second PCBs and comprises a combination of first and second (or mating) connector members to be connected to the first and the second PCBs, respectively.

The first connector member comprises a pair of first FPCs as two contact rows of a plurality of contact elements. Each of the first FPCs has a first end connected to the first PCB and a second end opposite to the first end and brought into contact with contacts of the second connector member. A pair of elastic plates are fixed to the second ends of the first FPCs, respectively.

The second connector member has a projection and a contact holding portion. The contact holding portion is provided with a pair of grooves in which the contacts are disposed to be exposed in end walls of the grooves. Each groove loosely receives the second end of each of the first FPCs when the first and the second connector members are mated. Simultaneously, the projection engages and urges each of the elastic plates to bring the second end of each of the first FPCs into press contact with the contacts of the second connector member.

In the known two-piece connector, if the contact holding portion is fixedly mounted at a level in the second connector member, a stature of the two-piece connector in a mated condition on the second PCB is almost equal to a total of a length of the first FPC and the level of the contact holding portion.

In a specific example of the known two-piece connector, the contact holding portion is movable along the projection. The second connector member further comprises a pair of second FPCs having first ends connected to the contacts in the contact holding portion and the second ends connected to a conductive portion of the second PCB to establish electrical connection therebetween.

In the specific example, when the second connector member is coupled to the first connector member, the contact holding portion moves downward to thereby bend or deform the second FPCs. Therefore, the stature of the two-piece connector in the mated condition on the second PCB is reduced. On the other hand, when the second connector member is separated or disconnected from the first connector member, the contact holding portion is moved upward. Following the downward and upward movement of the contact holding portion, the second FPCs are deformed and bent. The deformation may often cause breakage of mechanical and electrical connection between the second ends of the second FPCs and conductive patterns on the second PCB established by soldering. Thus, the reliability of mechanical and electrical connection is decreased. In addition, when the second FPCs are bent, stress is concentrated to the first and the second ends of the second FPCs connected to the contacts in the contact holding portion and the conductive patterns of the second PCB, respectively. This may result in breakage of the conductive patterns at the first and second ends of the second FPCs.

SUMMARY OF THE INVENTION

It is an object of this invention to provide a two-piece electrical connector using a flexible contact member and having a reduced stature in a mated condition.

It is another object to provide a two-piece electrical connector using a flexible contact member and capable of improving the reliability of mechanical and electrical connection between the flexible contact member and a PCB.

It is still another object of this invention to provide a two-piece electrical connector which is simplified in structure so as to dispense with parts or tools for a connecting operation and to facilitate the connecting operation.

This invention is directed to a two-piece electrical connector for electrically connecting a first PCB with a second PCB. The connector comprises a first connector member to be mounted on and electrically connected to the first PCB and a second connector member to be mounted on and electrically connected to the second PCB, the second connector member being coupled and decoupled with the first connector member for establishing connection and disconnection therebetween. According to this invention, the first connector member comprises:

a first insulator block to be mounted on the first PCB and having an actuating portion;

a second insulator block slidably coupled into the first insulator block in a sliding direction, the second insulator block having a space for receiving the second connector member and having a slit-like hole extending therein from the space and the first insulator block;

a flexible contact sheet comprising a flexible insulating sheet and conductive line patterns formed on one surface of the insulating sheet, the flexible contact sheet having a contact portion at one end which passes through the slit-like hole into the space for electrically connecting with the second connector member, the flexible contact sheet further having a connecting portion at the opposite end led out from the first insulator block for electrically and mechanically connecting with the first PCB; and a spring plate having one end jointed with the contact portion of the flexible contact sheet and a free end portion at the opposite end, the opposite end being brought into contact with the actuating portion to be deflected laterally when the second insulator block is pushed down in the sliding direction, the deflection causing a contact force of the contact portion against mating contacts of the second connector member received in the space by a lever action of the spring plate.

The second connector member comprises:

a mating insulator block to be mated into the space of the second insulator block; and a plurality of the mating contacts fixedly mounted in the mating insulator block.

The first PCB has a plurality of first wiring conductor patterns and a first ground conductor, and the second PCB has a plurality of second wiring conductor patterns and a second ground conductor. In the connector according to this invention, the flexible contact sheet has a ground pattern on the opposite surface of the flexible insulating sheet, and the mating contacts comprises a plurality of contact elements and at least one ground contact to be connected to the second wiring conductor patterns and the second ground conductor, respectively. The contact elements and the ground contact are brought into contact with the conductive line patterns and the ground pattern at the connection portion of the flexible contact sheet.

In the connector of this invention, preferably, the mating insulator block has a contact receiving to face the slit-like hole, the contact elements and the ground contact have contacting portions and a ground portion, respectively, disposed in the contact receiving hole. Each of the contacting portions and the ground portion are separated by a gap therebetween and offset from each other in the sliding direction. The contact portion of the flexible contact sheet is inserted together with the spring plate into the gap without insertion force when the second connector member is fitted into the space of the second insulator block.

In the the connector of this invention, the connecting portion is held between the first insulator block and the first PCB. The conductive line patterns and the ground pattern of the flexible contact sheet are connected to the first wiring conductors and the first ground conductor on the first PCB by soldering.

The connector of this invention can further comprise two sets of upper and lower rotary shaft members slidably and rotatably mounted in the first insulator block. The flexible contact sheet is wrapped around the upper and lower rotary shaft members continuously to thereby be controlled its bending deformation when the second insulator block is moved into the first insulator block in the sliding direction so as to establish connection of the second connector member with the first connector member.

DESCRIPTION OF THE PREFERRED EMBODIMENTS

Figure 1:
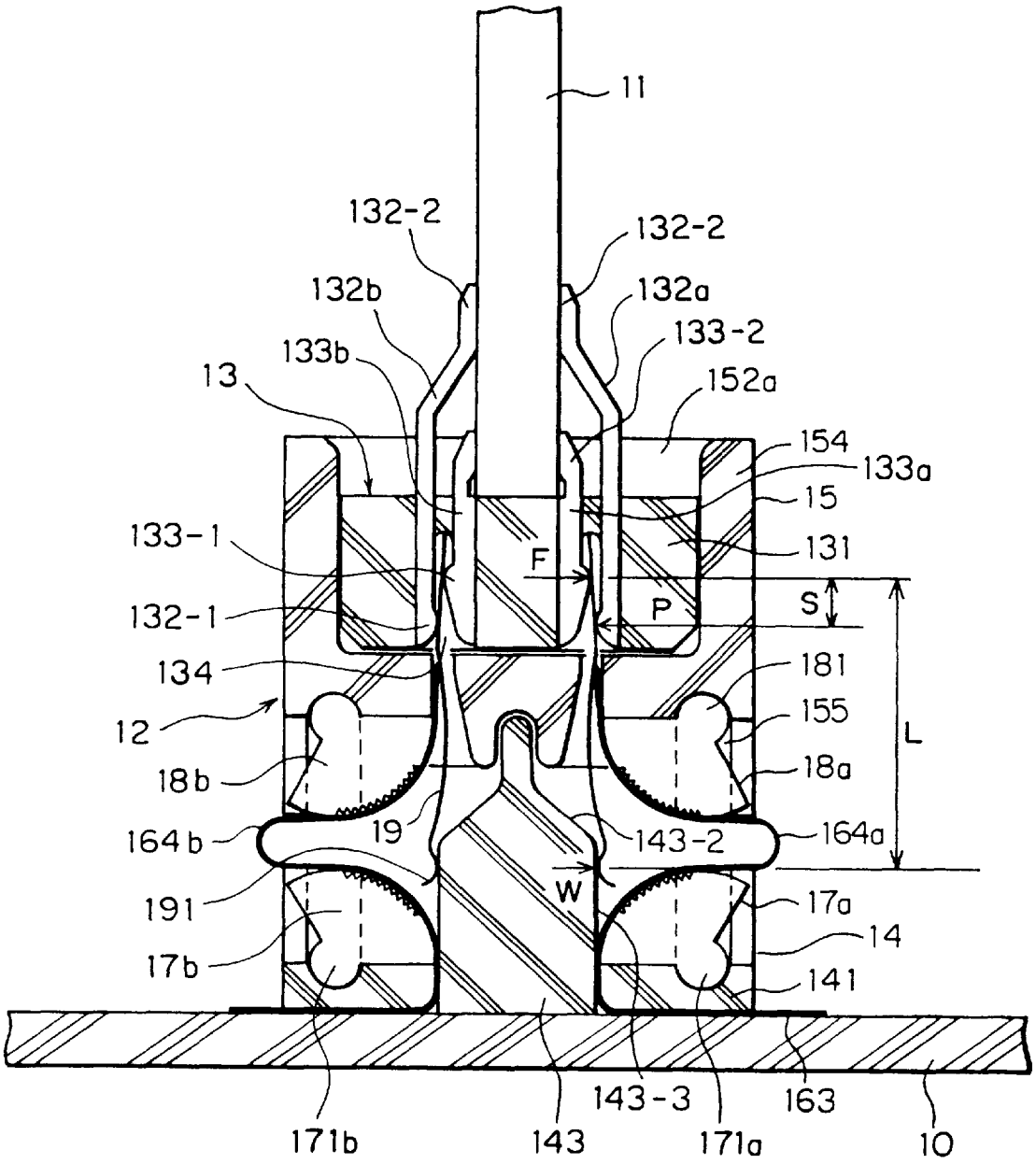
FIG. 1 is a sectional view of a two-piece electrical connector according to a first embodiment of this invention, with a connector member being mated with a mating connector member.

Referring to FIG. 1, a two-piece electrical connector according to a first embodiment of this invention shown therein is for electrically connecting a PCB 10 (which will be referred to as mother PCB) with another PCB 11 (which will be referred to as daughter PCB) and comprises a connector member 12 as a first connector member mounted on the mother PCB 10 and a mating connector member 13 as a second connector member mounted on the daughter PCB 11.

Figure 2:
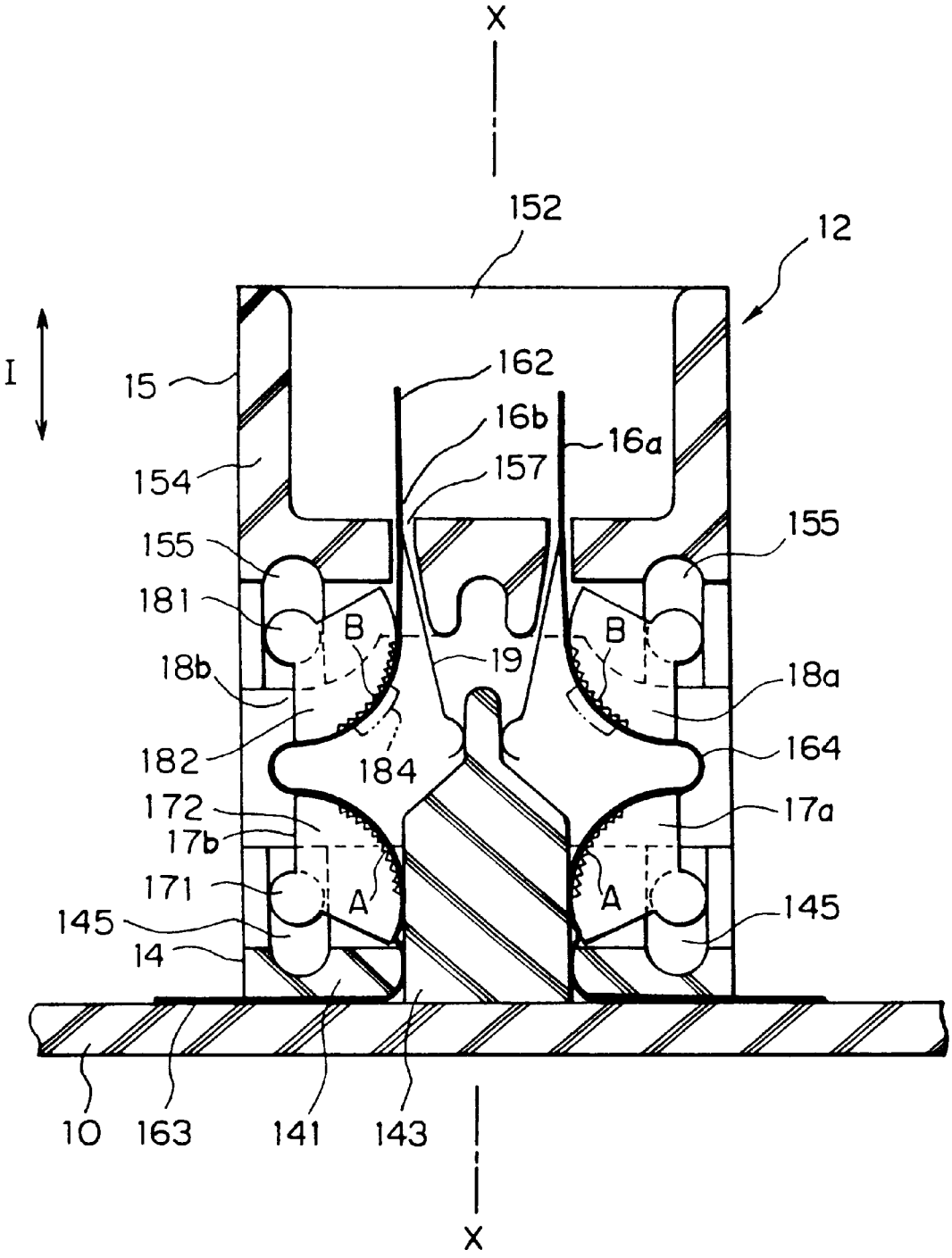
FIG. 2 is a sectional view of the connector member of the two-piece electrical connector of FIG. 1.
Figure 3:
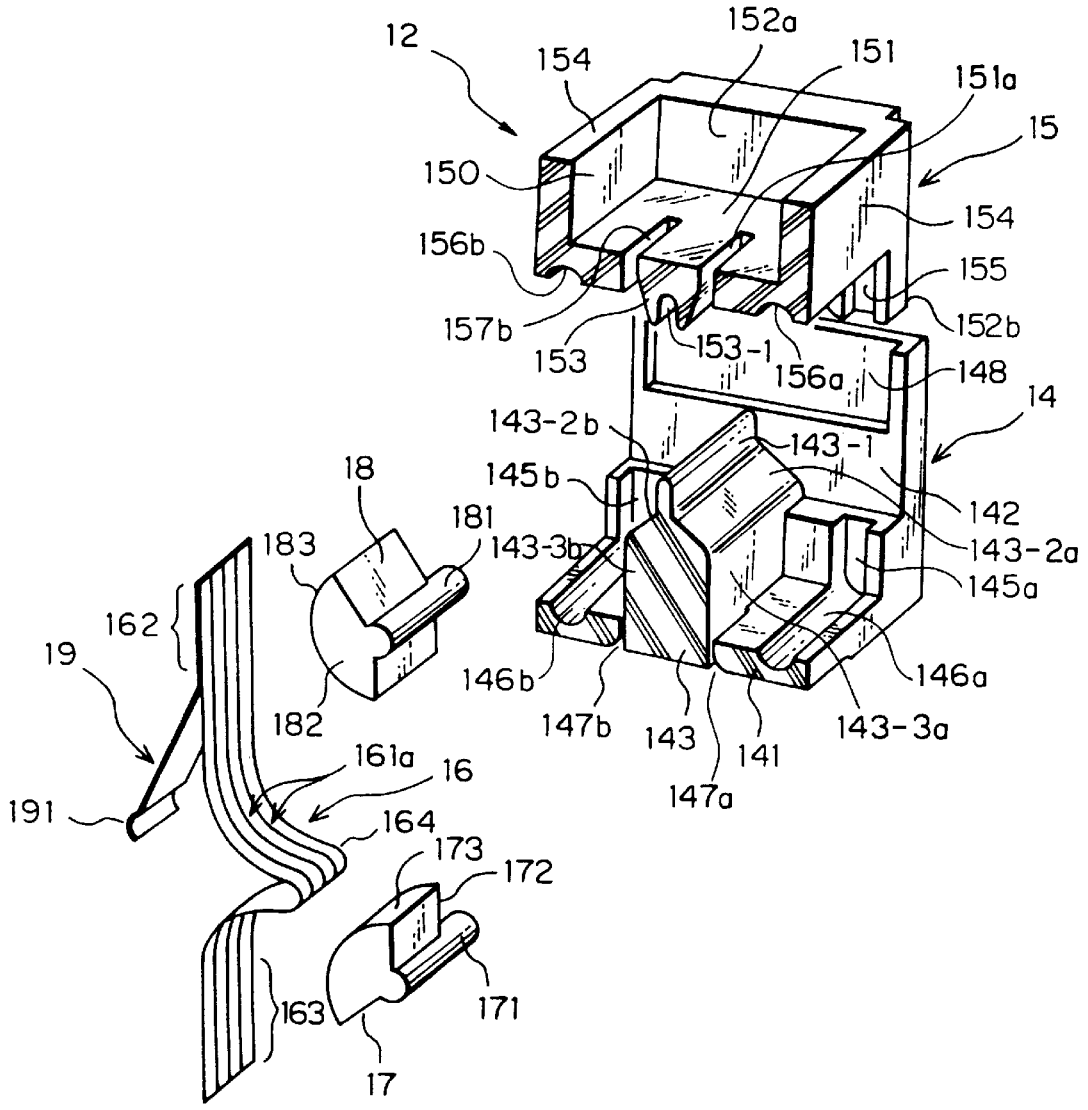
FIG. 3 is an exploded perspective view of the connector member of FIG. 2.

Referring to FIGS. 2 and 3 in addition, the connector member 12 comprises a first insulator block 14 fixedly mounted on the mother PCB 10, and a second insulator block 15 coupled to the first insulator block 14 to be movable oppositely in a direction shown at I in FIG. 2. It is noted here that the direction I is a direction perpendicular to a surface of the mother PCB 10. The second insulator block 15 moves in the direction I towards the mother PCB 10 to reach a coupling or mating position where the mating connector member 13 is mated with or coupled to the connector member 12 as shown in FIG. 1. The second insulator block 15 also moves in the direction I from the coupling position away from the mother PCB 10 so as to disconnect the mating connector member 13 from the connector member 12.

In the first and the second insulator blocks 14 and 15, a pair of flexible contact members or sheets 16*a* and 16*b* (which will collectively be referred to as 16), a pair of first rotary shaft members 17*a* and 17*b* (collectively 17), and a pair of second rotary shaft members 18*a* and 18*b* (collectively 18) are symmetrically arranged. Specifically, the flexible contact sheets 16*a* and 16*b* are arranged left and right with respect to an imaginary center plane intersecting the first and the second insulator blocks 14 and 15 to be symmetrical with each other. The imaginary center plane contains a symmetrical axis X illustrated in FIG. 2 and is perpendicular to the drawing sheet of FIG. 2. In the following description, any components in such symmetrical arrangement will be referred to as "the components are arranged at symmetrical positions". The first rotary shaft members 17*a* and 17*b* are further arranged at symmetrical positions and the second rotary shaft members 18*a* and 18*b* are also arranged at symmetrical positions.

In FIG. 3, there are shown ones of the flexible contact sheets 16, the first rotary shaft members 17 and the second rotary shaft members 18 for the purpose of simplification of the drawings.

The first insulator block 14 comprises a first base portion 141 parallel to the mother PCB 10, a pair of first end wall portions 142 standing upward in the direction I from both ends of the first base portion 141, and a press wall portion 143 extending upward in the direction I from the center of the first base portion 141.

Referring to FIG. 3, one of the first end wall portions 142 alone is illustrated therein. The first end wall portions 142 are opposite to each other. Each of the first end wall portions 142 has an inner wall surface provided with a pair of first engaging grooves 145*a* and 145*b* (collectively, 145) formed at symmetrical positions and extending from an inner surface of the first base portion 31 in the direction I.

Each of the first rotary shaft members 17 comprises a first shaft portion 171 having a center axis parallel to the first base portion 141, and a first arcuate portion 172 integral with the first shaft portion 171. Each of the second rotary shaft members 18 comprises a second shaft portion 181 having a center axis parallel to the second base portion 141 and a second arcuate portion 182 integral with the second shaft portion 181.

Each of the first arcuate portions 172 has an arcuate surface 173 with an obtuse segment angle. Likewise, each of the second arcuate portions 182 has an arcuate surface 183 with an obtuse segment angle.

Each of the first engaging grooves 145 of the first insulator block 14 is engaged with a protruding end of the first shaft portion 171 of the first rotary shaft member 17 that protrudes from the one end surface of the first arcuate portion 172. The first rotary shaft member 17 is slidable in the direction I and rotatable around the first shaft portion 171 as a rotation axis when the protruding end of the first shaft portion 171 is engaged with the first engaging groove 145.

In the inner or upper surface of the first base portion 141, a pair of first base grooves 146*a* and 146*b* (collectively 146) are formed at symmetrical positions and extend between the first end wall portions 142. Each of the first base grooves 146 intersects a lower end of a corresponding one of the first engaging grooves 145 and is continuous therefrom. When the first rotary shaft member 17 moves to the lower end of the first engaging groove 145, the first shaft portion 171 goes into the first base groove 146.

The first base portion 141 has a pair of slit-like through holes 147*a* and 147*b* (collectively 147) for passing connecting portions 163 of the flexible contact sheets 16 from the inside of the first base portion 141 to the outside of the first base portion 141 as will later be described in detail. The first through holes 147 are formed at symmetrical positions at both sides of the press wall portion 143 to be adjacent thereto.

The press wall portion 143 has a thin top portion 143-1 having a pair of first wall surfaces which are continuous to a pair of second wall surfaces 143-2*a* and 143-2*b* (collectively 143-2) of a middle wall portion. The second wall surfaces 143-2*a* and 143-2*b* are downwardly inclined outward in the first direction I, and are continuous to a pair of third wall surfaces 143-3*a* and 143-3*b* (collectively 143-3) of a base portion of the press wall portion. The first wall surfaces of the thin top portion 143-1 and the third wall surfaces 143-3 are parallel to the imaginary center plane.

Each of the first end wall portions 142 opposite to each other has a guide groove 148 formed in the inner wall surface thereof to receive the second insulator block 15 to a predetermined position, so that the second insulator block 15 is guided by the guide groove 148 when it is moved in the direction I. The guide groove 148 is located above the top end of the press wall portion 143.

The second insulator block 15 comprises a second base portion 151 opposite to the first base portion 141 in parallel thereto, and a pair of second end wall portions 152 standing from both ends of the second base portion 151 upwardly and downwardly, respectively, in the direction I. An upwardly extending portion and a downwardly extending portion of each of the second end wall portions 152 will be referred to as an upper end wall portion 152*a* and a lower end wall portion 152*b*, respectively. The second base portion 151 is provided with a positioning projection 153 downwardly extending from the center of the second base portion 151 in the direction I. A pair of connecting wall portions 154 connect the opposite upper end wall portions 152*a*, respectively.

In FIGS. 2 and 3, one of the second end wall portions 152 is shown for convenience of illustration.

In the second insulator block 15, a combination of the second base portion 151, the upper end wall portions 152*a*, and the connecting wall portions 154 forms a box-shaped coupling portion 150 having an open upper end. The coupling portion 150 is for receiving the mating connector member 13 which will later be described.

Each of the lower end wall portions 152*b* has an inner surface provided with a pair of second engaging grooves 155 extending in the first direction I. The second engaging grooves 155 are arranged at symmetrical positions. Each of the second engaging grooves 155 is engaged with a protruding end of the second shaft portion 181 of the second rotary shaft member 18 that protrudes from the one end surface of the second arcuate portion 182. The second rotary shaft member 18 is slidable in the second engaging groove 155 in the direction I and rotatable around the second shaft portion 181 as a rotation axis.

The second base portion 151 opposite to the first base portion 141 has an outer bottom surface provided with a pair of second base grooves 156*a* and 156*b* (collectively 156). The second base grooves 156 are arranged at symmetrical positions. Each of the second base grooves 156 intersects each of the second engaging grooves 155 of the lower end wall portions 152*b*. The second shaft portion 181 of the second rotary shaft member 18 is inserted into the second base groove 156 when the second shaft potion 181 moves to the uppermost end of the second engaging groove 155.

The second base portion 151 further has a pair of slit-like second through holes 157*a* and 157*b* (collectively 157) for passing contact portions 162 of the flexible contact sheets 16 from the outside of the second base portion 151 into the coupling portion 150 as will later be described. The second through holes 157*a* and 157*b* are formed at symmetrical positions along outer wall surfaces of the positioning projection 153.

The positioning projection 153 is provided with a positioning groove 153-1 for receiving the thin top portion 143-1 of the press wall portion 143 when the second insulator block 15 moves downwardly in the direction I.

As described above, the above-mentioned various components of the electrical connector are arranged at symmetrical positions. Therefore, in the following description, only one of the flexible contact sheets 16, only one of the first rotary shaft members 17, and only one of the second rotary shaft members 18 will be described together with the first and the second insulator blocks 14 and 15.

Figure 4:
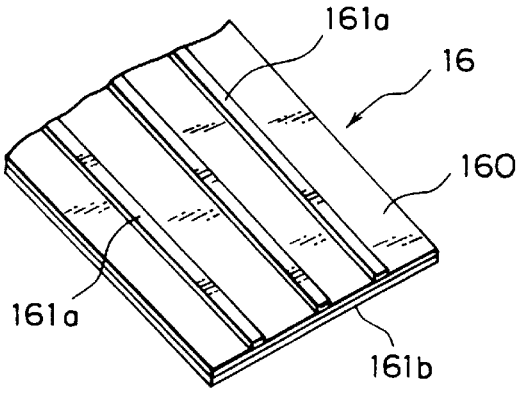
FIG. 4 is a perspective view of a flexible contact sheet illustrated in FIG. 1 as seen from a signal pattern side.

As seen from FIG. 4, the flexible contact sheet 16 comprises a belt-like insulating sheet 160 such as an insulating film having a small thickness, a plurality of conductive line patterns 161*a* attached to one surface of the sheet 160 to extend in a longitudinal direction of the sheet 160 with a predetermined interval from one another in a transversal direction, and a ground pattern 161*b* attached to the other surface of the sheet 160.

As illustrated in FIG. 3, the flexible contact sheet 16 has the contact portion 162 formed at a longitudinal one end thereof. The contact portion 162 passes through the second through hole 157 to protrude into the coupling portion 150. The flexible contact sheet 16 has the connecting portion 163 formed at the other longitudinal end. The connecting portion 163 passes through the first through hole 147 and between the outer bottom surface of the first base portion 141 and the mother PCB 10 to be drawn out from the first insulator block 14.

The contact portion 162 is provided with a leaf-like backup spring 19. The backup spring 19 is fixed at its top end portion to the ground pattern 161*b* of the contact portion 162 by soldering. The backup spring 19 has a leaf spring portion downwardly extending from the contact portion 162 to diverge therefrom. The backup spring 19 has a free end portion 191 of an arcuate shape formed at the lower end thereof.

As illustrated in FIG. 2, the top end portion of the backup spring 19 protrudes together with the contact portion 162 into the coupling portion 150 through the second through hole 157. The free end 191 of the backup spring 19 is brought into contact with the first wall surface of the thin top portion 143-1 of the press wall portion 143.

The connecting portion 163 of the flexible contact sheet 16 in this embodiment is formed by processing the flexible contact sheet 16 as will hereinafter be described in detail in conjunction with FIG. 5.

Figure 5:
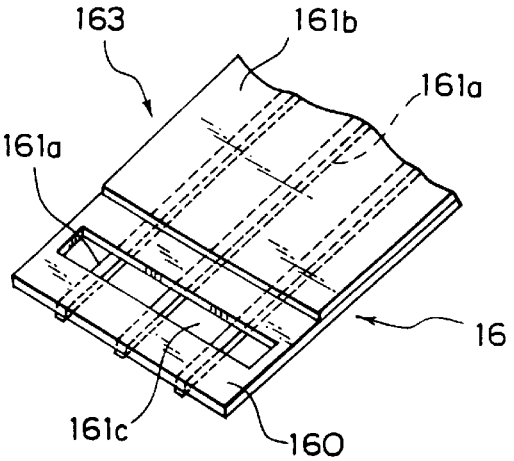
FIG. 5 is a perspective view of the flexible contact sheet illustrated in FIG. 4 as seen from a ground pattern side.

In the flexible contact sheet 16 illustrated in FIG. 5, the ground pattern 161*b* is partially removed at the end portion of the connecting portion 163 to expose one end portion of the insulating sheet 160. At the one end portion of the insulating sheet 160, a sheet hole 161*c* elongated in the transversal direction is formed. In the connecting portion 163 with the sheet hole 161*c*, the conductive line patterns 161*a* are bridged over the sheet hole 161*c* in the longitudinal direction and are exposed through the sheet hole 161*c*.

Figure 6:
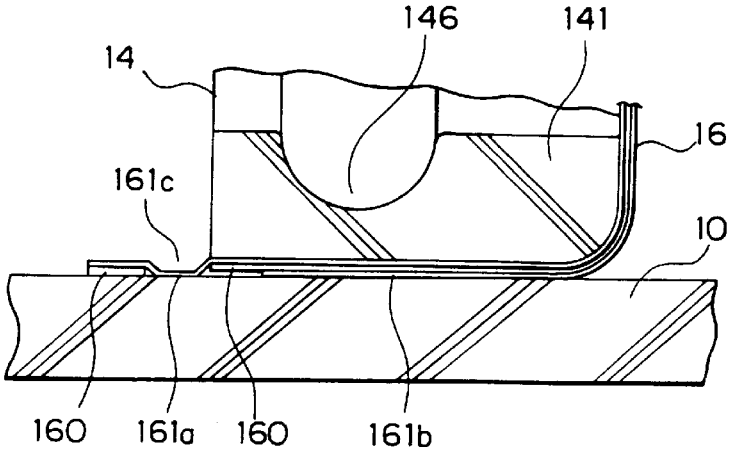
FIG. 6 is a sectional view of the flexible contact sheet illustrated in FIG. 4 when connected to a PCB.

Referring to FIG. 6, the connecting portion 163 passes through the first through hole 147 of the first insulator block 14 and is substantially perpendicularly bent to be positioned between the first base portion 141 and the mother PCB 10. Then, the connecting portion 163 extends along the mother PCB 10 so that the sheet hole 161*c* is located outside of the first insulator block 14.

At this time, the ground pattern 161*b* is brought into contact with an upper surface of the mother PCB 10 under the first base portion 141. The conductive line patterns 161*a* are faced to the outer bottom surface of the first base portion 141.

The mother PCB 10 has a ground conductor (not shown) formed on its upper surface to be connected to the ground pattern 161*b* under the first base portion 141. The ground conductor and the ground pattern 161*b* are connected to each other by welding or soldering. Those parts of the conductive line patterns 161*a* located outside of the first insulator block 14 and bridged over the sheet hole 161*c* are connected to a wiring conductor pattern (not shown) formed on the upper surface of the mother PCB 10 by welding or soldering.

Turning back to FIGS. 1, 2 and 3, the flexible contact sheet 16 has a longitudinal intermediate portion wrapped around the first and the second rotary shaft members 17 and 18 arranged above and below in alignment with each other in the direction I. Specifically, the flexible contact sheet 16 is wrapped around the first and the second arcuate portions 172 and 182 of the first and the second rotary shaft members 17 and 18.

Between the first and the second rotary shaft members 17 and 18, the flexible contact sheet 16 has a bent portion 164 having a generally U-shaped section formed by deforming the longitudinal intermediate portion thereof. The flexible contact sheet 16 is partially bonded to the first and the second arcuate surfaces 173 and 183 of the first and the second arcuate portions 172 and 182 at bonding areas A and B on both sides of the bent portion 164, respectively, by use of an adhesive. Therefore, the bonding areas A and B of the flexible contact sheet 16 is not varied in curvature even when the first and the second insulator blocks 14 and 15 are moved relative to each other. In the bonding areas A and B (see FIG. 2), the one surface of the flexible contact sheet 16 with the conductive line patterns 161*a* is bonded to the first and the second arcuate surfaces 173 and 183.

Instead of bonding by the adhesive, the first and the second rotary shaft members 17 and 18 may be fastened to the flexible contact sheet 16 by mechanical coupling. Specifically, a protrusion 184 may be formed on the second arcuate surface 183 of at least the second arcuate portion 182 as depicted by two-dot-and-dash line in FIG. 2. On the other hand, an engaging hole (not shown) is formed in the flexible contact sheet 16 and receives the protrusion 184 therein. Thus, the protrusion 184 engages with the engaging hole, so that it is also possible to keep those areas of the flexible contact sheet 16 unchanged in curvature.

When the second insulator block 15 is pushed down in the direction I, the second arcuate portion 182 of the second rotary shaft member 18 is downwardly pressed by the second base portion 151. Therefore, the second rotary shaft member 18 is rotated in a predetermined rotating direction and simultaneously the second shaft portion 181 slides downwardly in the second engaging groove 155. As a result, the bent portion 164 of the flexible contact sheet 16 is laterally pushed out. Thereby, the first rotary shaft member 17 is rotated in a rotating direction opposite to the predetermined rotating direction. Simultaneously, the first rotary shaft member 17 moves downwardly and the first shaft portion 171 slides downwardly in the first engaging groove 145. This is because the bent portion 164 is pushed down by the downward movement of the second rotary shaft member 18 as described above. As a consequence, the first and the second arcuate surfaces 173 and 183 are faced to each other.

Returning to FIG. 1, the mating connector member 13 is coupled into the coupling portion 150 of the second insulator block 15 and is mated with the connector member 12.

The mating connector member 13 comprises a mating insulator 131, a pair of contact rows each having a plurality of contact elements 132 fixed to the mating insulator 131, and a pair of ground contact rows each having a plurality of ground contact elements 133 also fixed to the mating insulator 131. The paired contact rows of contact elements 132 are corresponding to the pair of flexible contact sheets 16*a* and 16*b*, respectively. Therefore, the contact elements 132 (only one contact element in each contact row is shown in the figure) corresponding to the flexible contact sheets 16*a* and 16*b* are shown at 132*a* and 132*b*, respectively. The contact elements 132 in each contact row are corresponding to conductive line patterns 161*a* of the corresponding one of contact sheets 16. The paired ground contact rows of ground contact elements 133 (only one ground contact element in each ground contact row is shown in the figure) are corresponding to ground patterns 161*a* and 161*b* of the pair of flexible contact sheets 16*a* and 16*b* and are, therefore, shown at 133*a* and 133*b*, respectively, in the figure.

One pair of ground contact elements can be provided for the one pair of the flexible contact sheets 16, because the ground pattern on either one of the flexible contact sheets 16 is a single pattern overlying on the surface of the sheet.

The mating insulator 131 is provided with a pair of contact receiving holes 134*a* and 134*b* (collectively 134) each of which is for receiving the contact portion 162 of the flexible contact sheet 16 and the top end portion of the backup spring 19. In each of the contact receiving holes 134, the contact elements 132 of the corresponding contact row and the corresponding ground contact element 135 are disposed. In detail, the mating contact element 132 has a mating contact portion 132-1 formed at its one end and disposed in the contact receiving hole 134. The ground contact element 133 has a ground contact portion 133-1 formed at its one end and also disposed in the contact receiving hole 134. The ground contact portion 133-1 is located to be offset from the mating contact portion 132-1 in the direction I. The mating contact portion 132-1 is to be brought into contact with the conductive line patterns 161*a* of the flexible contact sheet 16. On the other hand, the ground contact portion 133-1 is to be brought into contact with the ground pattern 161*b* of the flexible contact sheet 16.

The mating contact element 132 and the ground contact element 133 upwardly extend from the mating insulator 131 in the direction I and have a contact terminal portion 132-2 and a ground terminal portion 133-2 at their extending ends, respectively.

The mating connector member 13 is mounted at one edge of the daughter PCB 11 with electrical connection therewith. The daughter PCB 11 has signal-line conductor patterns and ground conductor patterns formed on both surfaces thereof, although not shown in the figure. The contact terminal portion 132-2 is connected to the corresponding one of the signal line conductor patterns by soldering or welding. The ground terminal portion 133-2 is connected to the corresponding one of the ground conductor patterns by soldering or welding.

It should be noted that there is a gap established between the mating contact portion 132-1 and the ground contact portion 133-1 so as to permit the contact portion 162 of the flexible contact sheet 16 to be inserted thereinto with zero insertion force (ZIF).

Referring to FIGS. 1 and 2, description will be made about the operation of connecting the mother PCB 10 and the daughter PCB 11 by the two-piece electrical connector.

At first referring to FIG. 2, the second insulator block 15 is coupled to the first insulator block 14. Then, the contact portion 162 of the flexible contact sheet 16 is inserted into the corresponding slit-like through hole 157 together with the top end portion of the backup spring 19, while the free end 191 of the backup spring 19 is brought into contact with the outer surface of the thin top portion 143-1 of the press wall portion 143 of the first insulator block 14. In this state, the second rotary shaft member 18 is pushed upward in the direction I by the restoring force of the bent portion 164 of the flexible contact sheet 16.

Then, the mating connector member 13 illustrated in FIG. 1 is coupled to the coupling portion 150, while the contact portion 162 of the flexible contact sheet 16 is inserted in the gap between the mating contact portions 132-1 and the ground contact portions 133-1 with the zero insertion force. In this state, the free end 191 of the backup spring 19 is still in contact with the outer surface of the thin top portion 143-1 of the press wall portion 143.

Next, the second insulator block 15 is pushed down together with the daughter PCB 11 and the mating connector member 13 towards the first insulator block 14 in the direction I. The free end 191 of the backup spring 19 is pushed outward by the second wall surface 143-2 which is inclined outward in the first direction I so that the backup spring 19 is gradually deformed to approach the flexible contact sheet 16. Finally, the free end 191 is elastically pressed against the third wall surface 143-3 of the press wall portion 143. When the free end 191 is subjected to the pressing force, the contact portion 162 is brought into press contact onto the mating contact portion 32-1 and the ground contact portion 133-1 by lever action of the backup spring 19.

On the other hand, when the second insulator block 15 is pushed down, the second rotary shaft member 18 is rotated around the second shaft portion 181 in the direction due to the fact that the arcuate portion 182 is pushed by the second base portion 151 of the second insulator block 15. As a result, the bent portion 164 is pushed out from the second rotary shaft member 18 and laterally extends from the first and the second shaft members 17 and 18. This is because the first arcuate portion 172 already engages with the first base portion 141 of the first insulator block 14. Therefore, the first shaft portion 171 is pushed down in the first engaging groove 145 and is rotated in the opposite direction.

When the second insulator block 15 is completely fitted into the first insulator block 14, the bent portion 164 of the flexible contact sheet 16 is compressed in the first direction I. However, each of the bonding areas A and B of the flexible contact sheet 16 is always kept at the constant curvature. The flexible contact sheet 16 is deformed at adjacent portions immediately before and after the bonding areas A and B between a linear shape and a curved shape, when the second rotary shaft member 18 is rotated. However, it is possible to suppress the stress of the flexible contact sheet 16 due to the deformation by selecting the curvature of the first and the second rotary shaft members 17 and 18 to an appropriate value.

In case where the protrusion 184 is formed on the second arcuate surface 183 as described above, the relative operation of the first and the second rotary shafts 17 and 18 and the flexible contact sheet 16 is similar to the above-described operation.

When the first and the second insulator blocks 14 and 15 are coupled to each other, the free end 191 of the backup spring 19 receives a reaction force W from the third wall surface 143-3 of the press wall portion 143, as described in FIG. 1. The reaction force W produces first and second contacting forces P and F of the contact portion 162 against the ground contact portion 133-1 and the mating contact portion 132-1. It is providing that The offset in the direction I between the mating contact portion 132-1 and the ground contact portion 133-1 is represented by S, while a distance between the ground contact portion 133-1 and the free end 191 is represented by L. In this event, the relationship $W=S/L \cdot P$ is given. If S/L is small, the reaction force W is also small. This means that a force is relatively small for pressing down the second insulator block 15 together with the daughter PCB 11 and the mating connector member 13.

In the coupled state, the flexible contact sheet 16 is deformed and produces a restoring force which forces the mating connector member 13 upward in the direction I. However, a frictional force by the reaction force W is present between the free end 191 of the backup spring 19 and the third wall surface 143-3 of the first insulator block 14. Therefore, if the restoring force is smaller than the frictional force, the mating connector member 13 is kept coupled. If the restoring force is greater than the frictional force, the mating connector member 13 may be released in the direction I. In the latter case, any locking mechanism should be provided in order to prevent the mating connector member 13 from undesiredly released.

Figure 7:
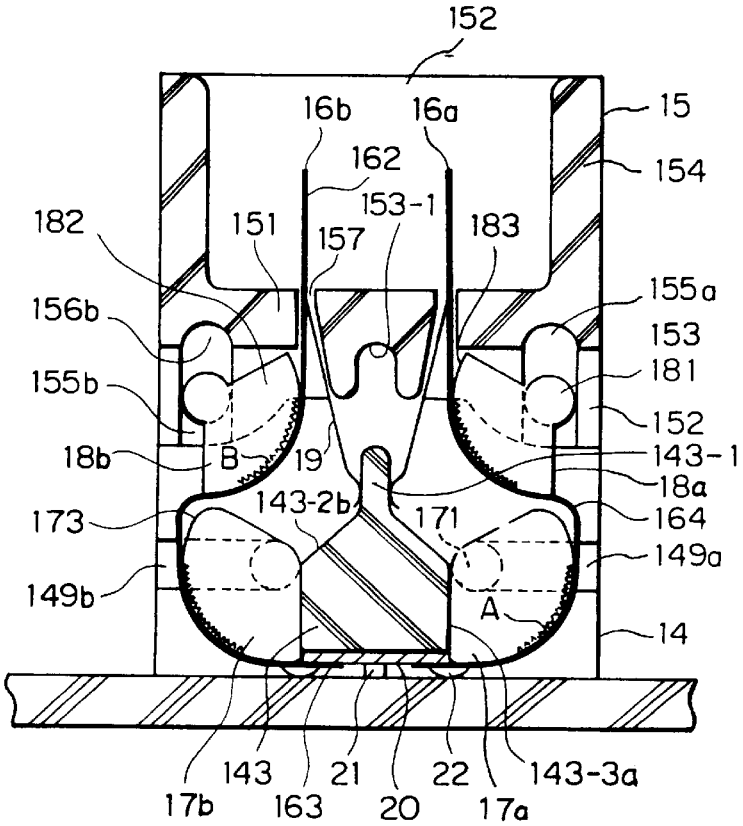
FIG. 7 is a sectional view of a modification of the connector member.
Figure 8:
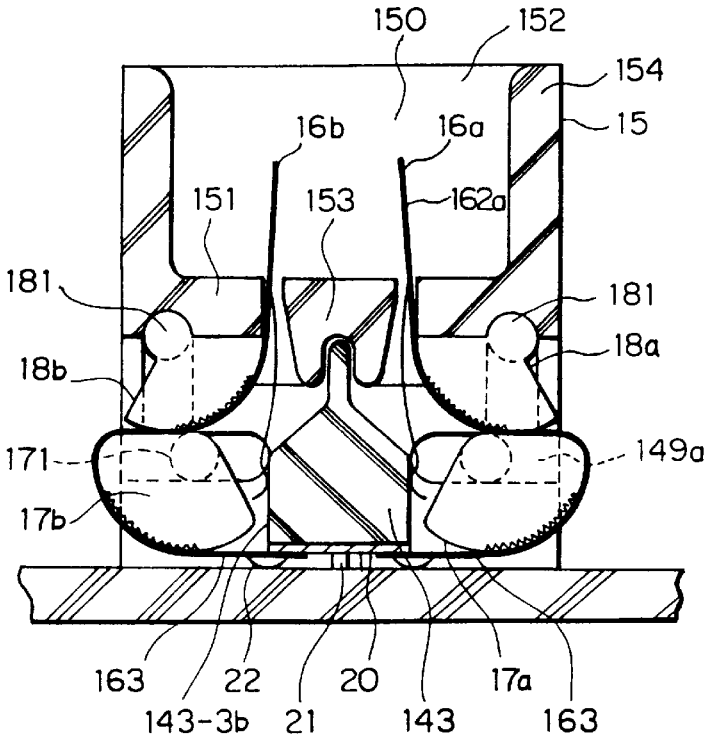
FIG. 8 is a sectional view of the electrical connector illustrated in FIG. 7 in a condition coupled to the mating connector not shown.

Referring to FIGS. 7 and 8, description will be made as to a two-piece electrical connector according to a second embodiment of this invention. Since a mating connector member is similar to that in the first embodiment of FIG. 1, illustration and description thereof are omitted hereto for the simplification. A connector member is also similar to that of the first embodiment but different in the arrangement of the first shaft portion 171 of the first rotary shaft member 17. Similar parts are designated by like reference numerals and will not be described any longer.

As illustrated in FIG. 7, the first insulator block 14 in this embodiment is similar to that shown in FIGS. 1–3 but does not have the first base portions 141 shown in FIGS. 1–3. Each of the first end wall portions 142 has a pair of lateral engaging grooves 149*a* and 149*b* (collectively 149) in place of the combination of the first engaging grooves 145 and the first base grooves 146 in FIG. 3. The lateral engaging grooves 149*a* and 149*b* are formed in each of the first end wall portions 142 to laterally extend at a level equal to the top end of the first engaging grooves 145 in FIG. 2 in a direction parallel to the mother PCB 10. The first shaft portion 171 of the first rotary shaft member 17 engages with the lateral engaging groove 149, so that the first rotary shaft member is movable in a direction parallel to the mother PCB 10 and is rotatable about the first shaft portion 171. Further, the first arcuate surface 173 is located at a reverse side to the second arcuate surface 183. The press wall portion 143 of the first insulator block 14 is provided with a conductive ground plate 20 and a ground projection 21 for electrically connecting the ground plate 20 to the ground conductor of the mother PCB 10 when the connector member 12 is mounted on the mother PCB 10. A small gap is left between the ground plate 20 and the mother PCB 10.

In the manner similar to the first embodiment, the flexible contact sheet 16 is wrapped around the second rotary shaft member 18 to that the conductive line patterns 161*a* are faced to the second arcuate surface 183. The flexible contact sheet 16 is also wrapped around the first rotary shaft member 17 so that the ground pattern 161*b* is faced to the first arcuate surface 173. The flexible contact sheet 16 is bonded to the first and the second arcuate surfaces 173 and 183 at the bonded areas A and B. Therefore, after the flexible contact sheet 16 passes the first arcuate surface 173, it extends under the ground plate 20. As a result, the ground pattern 161*b* at the connecting portion 163 faces the ground plate 20. The ground pattern 161*b* is connected to the ground plate 20 by soldering or welding.

On the other hand, the conductive line patterns 161*a* at the connecting portion 163 are faced to the signal conductor (not shown) formed on the mother PCB 10. The conductive line patterns 161*a* and the signal conductor are connected by solder balls 22.

When the second insulator block 15 is pushed down in the direction I, the second arcuate portion 182 is pressed by the second base portion 151 to be rotated in a first predetermined direction with the second shaft portion 181 sliding along the second engaging groove 155. At this time, the second arcuate portion 182 is moved together with the flexible contact sheet 16. Then, the second arcuate surface 183 is brought into contact with the first arcuate surface 173 through the flexible contact sheet 16. At this time, the first arcuate portion 172 starts to rotate in a second predetermined direction reverse to the first predetermined direction. The first arcuate portion 172 is further pressed by the second arcuate portion 182 to rotate in the second predetermined direction with the first shaft portion 171 sliding in the first engaging groove 149.

For clarity of the description, consideration will be made about the left half of the figure for the time being. Specifically, when the second insulator block 15 is pushed down in the direction I, the top end of the second arcuate portion 182 is brought into contact with the second base portion 151 so that the second rotary shaft member 18 is rotated in the clockwise direction. By the clockwise rotation, the bottom end of the second arcuate portion 182 is moved leftward in FIG. 8 together with the flexible contact sheet 16. When the second insulator block 15 is further pushed down, the second arcuate surface 183 of the second rotary shaft member 18 is brought into contact with the upper surface of the first rotary shaft member 17. Accordingly, the first rotary shaft member 17 is rotated in the counterclockwise direction and moved leftward in FIG. 8.

It will be understood that the directions of rotation and movement are reversed in the right half of the figure.

It is also possible in the second embodiment to suppress the stress resulting from deformation of the flexible contact sheet 16 by selecting the curvature of the first and the second rotary shaft members 17 and 18 to an appropriate value.

In the first and the second embodiments, the electrical connector comprising the first and the second rotary shaft members 17 and 18 has been described. However, the first and the second rotary shaft members 17 and 18 may be omitted so as to simplify the two-piece electrical connector, although the deformation of the flexible contact sheet 16 cannot be controlled.

In the first and the second embodiments, a pair of the flexible contact sheets 16, a pair of the first rotary shaft members 17, and a pair of the second rotary shaft members 18 are arranged between the first and the second insulator blocks 14 and 15 at symmetrical positions. However, this invention is also applicable to an electrical connector having a single flexible contact sheet 16, a single first rotary shaft member 17, and a single second rotary shaft member 18 are arranged between the first and the second insulator blocks 14 and 15.

As described in conjunction with the embodiments, the connecting portion 163 of the flexible contact sheet 16 is held between the first base portion 141 and the mother PCB 10 and is pressed onto the mother PCB 10 by the first base portion 141. With this structure, the connector member of this invention can prevent the bending force of the flexible contact sheet 16 from being transmitted to the connecting portion 163 connected to the mother PCB 10. It is therefore possible to improve the reliability of connection.

Since the bending or deformation of the flexible contact sheet 16 drives the rotation and the movement of the first and the second rotary shaft members 17 and 18, stress concentration at the junction for connection of the flexible contact sheet 16 can be avoided. It is therefore possible to avoid line interruption at the junction.

After the second insulator block 15 is coupled to the first insulator block 14, the restoring force is produced by the deformation of the flexible contact sheet 16 and acts to return the second insulator block 15 in the direction I. However, the restoring force of the flexible contact sheet 16 is cancelled by the free end 191 of the backup spring 19 brought into frictional contact with the third wall surface 143-3 of the press wall portion 143.

Since the electrical connector of this invention is simple in structure, it is possible to dispense with various tools for coupling operation and to facilitate the operation.

The first and the second insulator blocks 14 and 15 need not be increased in thickness in order to prevent the damage of the flexible contact sheet 16.

What is claimed is:

1. An electrical connector having a flexible contact member for electrically connecting a first printed circuit board (PCB) and a mating connector connected to a second PCB, comprising:

a first insulator block to be mounted on said PCB, said first insulator block comprising a first base portion parallel to said first PCB, a press wall portion standing upward from the center of said first base portion in a direction perpendicular to said first PCB, a pair of first end wall portions standing from both ends of said first base portion in said direction, and a first through hole penetrating said first base portion in said direction;

a second insulator block coupled to said first insulator block to be reciprocally movable in said direction, said second insulator block comprising a second base portion arranged opposite to said first base portion in parallel thereto, a pair of second end wall portions extending from both ends of said second base portion in said first direction and coupled to said first end wall portions to be movable along said first end wall portions, and a second through hole penetrating said second base portion in said direction;

said flexible contact member comprising an insulating sheet and conductive line patterns formed on one surface of said sheet, said flexible contact member having one end provided with a contact portion protruding through said second through hole to a position above said second base portion and the other end provided with a connecting portion extending through said first through hole onto an outer bottom surface of said first base portion to be connected to said first PCB, said contact portion being inserted into a mating contact portion of said mating connector member with zero insertion force when said mating connector is located on said second base portion, said flexible contact member being deformable to thereby reduce its stature from said connecting portion to said contact portion when said second insulator block is pushed down in said direction; and a backup spring having one end fixed to said contact portion, said backup spring extending from the one end towards said first base portion and having the other end as a free end to be brought into contact with said press wall portion;

said press wall portion having pressing means for pressing said free end of said backup spring, thereby said backup spring being deformed when said second insulator block is pushed downward in said direction, so that said free end is elastically pressed against said press wall portion to bring said contact portion into contact with said mating contact portion by lever action.

2. An electrical connector as claimed in claim 1, wherein said press wall portion has a first wall surface to be brought into contact with said free end before said second insulator block is pushed down in said direction, a second wall surface for pressing said backup spring to elastically deflect said backup spring in a lateral direction of approaching said flexible contact member when said second insulator block is being pushed down in said direction, and a third wall surface to be brought into elastic contact with said free end when said second insulator block is completely coupled to said first insulator block.

3. An electrical connector as claimed in claim 2, wherein said third wall surface is pressed against said free end with frictional force greater than restoring force resulting from deformation of said flexible contact member to inhibit the movement of said second insulator block in said direction when said second insulator block is pushed down in said direction.

4. An electrical connector as claimed in claim 1, wherein said flexible contact member further has a ground pattern formed on the other surface of said sheet, the one end of said backup spring being fixed to said ground pattern on said contact portion.

5. An electrical connector as claimed in claim 4, wherein said conductive line patterns on said connecting portion extend from an outer bottom surface of said first base portion through said first through hole outward of said first insulator block to be connected to wiring conductor patterns on said first PCB, said ground pattern on said connecting portion being connected to a ground conductor on said first PCB.

6. An electrical connector as claimed in claim 5, wherein said ground pattern is connected to said ground conductor between the outer bottom surface of said first base portion and said first PCB.

7. An electrical connector as claimed in claim 5, wherein said connecting portion extending outward of said first insulator block has a sheet hole elongated in a transversal direction and formed in an exposed area of said sheet where said ground pattern is removed, said conductive line patterns being bridged over said sheet hole and being connected to said wiring conductor patterns.

8. An electrical connector as claimed in claim 5, wherein said press wall portion has a bottom surface provided with a conductive ground plate to be connected to said ground conductor on said first PCB and a ground projection formed on said ground plate to electrically connect said ground plate with said ground conductor of said first PCB, said ground pattern being connected to said ground plate, said conductive line patterns being connected to said wiring conductor patterns via a solder ball.

9. An electrical connector as claimed in claim 1, wherein said flexible contact members, said backup springs, and said first and said second through holes are symmetrically arranged in said first and said second insulator blocks with respect to an imaginary plane containing a center axis of said first and said second insulator blocks.

10. An electrical connector as claimed in claim 1, further comprising first and second rotary shaft members coupled to said first and said second insulator blocks, respectively;

said first rotary shaft member having a first shaft portion parallel to said first base portion and a first arcuate portion formed on said first shaft portion, said second rotary shaft member having a second shaft portion parallel to said second base portion and a second arcuate portion formed on said second shaft portion;

each of said first end wall portions having a first engaging groove engaged with a top end of said first shaft portion so that said first shaft portion is slidable and rotatable, each of said second end wall portions having a second engaging groove engaged with a top end of said second shaft portion so that said second shaft portion is slidable and rotatable;

said intermediate portion of said flexible contact member being continuously wrapped around first and second arcuate surfaces of said first and said second arcuate portions to form a bent portion between portions around said first and second arcuate surfaces.

11. An electrical connector as claimed in claim 10, wherein said first engaging grooves of each of said first end wall portions extend from both ends of said first base portion in said second direction, said second engaging grooves of said second wall portions extending from both ends of said second base portion in said direction.

12. An electrical connector as claimed in claim 10, wherein said first and said second rotary shaft members are aligned above and below in a vertical direction between said first and said second insulator blocks in a manner such that, when said second insulator block is pushed down in said direction, said first arcuate portion is pressed by said first base portion to rotate in a predetermined direction with said first shaft portion moving in said first engaging groove while said second arcuate portion is pressed by said second base portion to rotate in a direction opposite to said predetermined direction with said second shaft portion moving in said second engaging groove, so that said first and said second arcuate surfaces are faced to each other.

13. An electrical connector as claimed in claim 12, wherein said one surface of said flexible contact member is faced to said first and said second arcuate surfaces.

14. An electrical connector as claimed in claim 10, wherein said first engaging grooves of said first end wall portions extend in a direction parallel to said first base portion, said second engaging grooves of said second end wall portions extending from both ends of said second base portion in said direction.

15. An electrical connector as claimed in claim 14, wherein said first and said second rotary shaft members are aligned above and below in a vertical direction between said first and said second insulator blocks in a manner such that, when said second insulator block is pushed down in said direction, said second arcuate portion is pressed by said second base portion to rotate in a predetermined direction with said second shaft portion moving in said second engaging groove while said first arcuate portion moves with said flexible contact member, said second arcuate portion rotating, when said second arcuate surface is brought into contact with said first arcuate portion, in said predetermined direction while said first arcuate portion is pressed by said second arcuate portion to rotate in a direction opposite to said predetermined direction with said first shaft portion moving in said first engaging groove.

16. An electrical connector as claimed in claim 15, wherein the other side surface having said ground pattern of said flexible contact member is faced to said first and said second arcuate surfaces.

17. An electrical connector as claimed in claim 10, wherein a part of each of said first and said second arcuate surfaces and a corresponding part of said flexible contact member corresponding to said part are bonded to each other.

18. An electrical connector as claimed in claim 10, wherein at least said second arcuate surface has a projection while said flexible contact member has an engaging hole to be engaged with said projection.

19. An electrical connector as claimed in claim 10, wherein said first and said second rotary shaft members and said first and said second engaging grooves are symmetrically arranged in said first and said second insulator blocks with respect to an imaginary plane containing a center axis of said first and said second insulator blocks.

20. A two-piece electrical connector for electrically connecting a first PCB with a second PCB, comprising a first connector member to be mounted on and electrically connected to said first PCB and a second connector member to be mounted on and electrically connected to said second PCB, said second connector member being coupled and decoupled with said first connector member for establishing connection and disconnection therebetween, wherein said first connector member comprises:

a first insulator block to be mounted on said first PCB and having an actuating portion;

a second insulator block slidably coupled into said first insulator block in a sliding direction, said second insulator block having a space for receiving said second connector member and having a slit-like hole extending therein from said space and said first insulator block;

a flexible contact sheet comprising a flexible insulating sheet and conductive line patterns formed on one surface of said insulating sheet, said flexible contact sheet having a contact portion at one end which passes through said slit-like hole into said space for electrically connecting with said second connector member, said flexible contact sheet further having a connecting portion at the opposite end led out from said first insulator block for electrically and mechanically connecting with said first PCB; and a spring plate having one end jointed with said contact portion of said flexible contact sheet and a free end portion at the opposite end, said opposite end being brought into contact with said actuating portion to be deflected laterally when said second insulator block is pushed down in the sliding direction, said deflection causing a contact force of said contact portion against mating contacts of said second connector member received in said space by a lever action of said spring plate;

and wherein said second connector member comprises:

a mating insulator block to be mated into said space of said second insulator block; and a plurality of said mating contacts fixedly mounted in said mating insulator block.

21. The connector as claimed in claim 20, said first PCB having a plurality of first wiring conductor patterns and a first ground conductor, and said second PCB having a plurality of second wiring conductor patterns and a second ground conductor, wherein said flexible contact sheet has a ground pattern on the opposite surface of said flexible insulating sheet, and said mating contacts comprises a plurality of contact elements and at least one ground contact to be connected to said second wiring conductor patterns and said second ground conductor, respectively, said contact elements and said ground contact being brought into contact with said conductive line patterns and said ground pattern at said connection portion of said flexible contact sheet.

22. The connector as claimed in claim 21, wherein said mating insulator block has a contact receiving to face said slit-like hole, said contact elements and said ground contact having contacting portions and a ground portion, respectively, disposed in said contact receiving hole, each of said contacting portions and said ground portion being separated by a gap therebetween and offset from each other in said sliding direction, said contact portion of said flexible contact sheet being inserted together with said spring plate into said gap without insertion force when said second connector member is fitted into said space of said second insulator block.

23. The connector as claimed in claim 22, wherein said connecting portion is held between said first insulator block and said first PCB, said conductive line patterns and said ground pattern of said flexible contact sheet being connected to said first wiring conductors and said first ground conductor on said first PCB by soldering.

24. The connector as claimed in claim 23, which further comprises two sets of upper and lower rotary shaft members slidably and rotatably mounted in said first insulator block, said flexible contact sheet being wrapped around said upper and lower rotary shaft members continuously to thereby be controlled its bending deformation when said second insulator block is moved into said first insulator block in said sliding direction so as to establish connection of said second connector member with said first connector member.

* * * * *